US006251839B1

(12) United States Patent
Faci

(10) Patent No.: US 6,251,839 B1
(45) Date of Patent: Jun. 26, 2001

(54) OPEN GEAR LUBRICANTS

(75) Inventor: Hocine Faci, Batavia, IL (US)

(73) Assignee: Castrol Limited, Wiltshire (GB)

( * ) Notice: Subject to any disclaimer, the term of this patent is extended or adjusted under 35 U.S.C. 154(b) by 0 days.

(21) Appl. No.: 09/380,260

(22) PCT Filed: Feb. 18, 1998

(86) PCT No.: PCT/GB98/00506

§ 371 Date: Sep. 21, 1999

§ 102(e) Date: Sep. 21, 1999

(87) PCT Pub. No.: WO98/38267

PCT Pub. Date: Sep. 3, 1998

(30) Foreign Application Priority Data

Feb. 28, 1997 (GB) ..... 9704261

(51) Int. Cl.[7] ..... C10M 169/02; C10M 125/02; C10M 125/10

(52) U.S. Cl. ..... 508/116; 508/126; 508/136

(58) Field of Search ..... 508/113, 126, 508/116, 136

(56) References Cited

U.S. PATENT DOCUMENTS 4,305,831 * 12/1981 Johnson, III et al. ..... 508/113
5,180,509 * 1/1993 Jacobs et al. ..... 508/113
5,595,965 * 1/1997 Wiggins ..... 508/491
5,858,934 * 1/1999 Wiggins et al. ..... 508/486
5,955,402 * 9/1999 Hirara et al. ..... 508/106

FOREIGN PATENT DOCUMENTS 09-208943 * 8/1997 (JP) .

OTHER PUBLICATIONS

Dialog Information Services, File 351, Derwent WPI, Dialog accession No. 011131348, WPI accession no. 97–109272/199710, (Engen Petroleum Ltd), "Low Toxicity and Biodegradable Lubricant Compsn. Esp. Useful as a Machine Grease—Comprises Tall Oil and an Organophilic Clay Uniformly Dispersed Therein".

Industrial Lubrication and Technology, vol. 46, No. 3, 1994, T.W. Dicken, "Biodegradable Open Gear Grease", p. 1/5, columns 1 and 2.

* cited by examiner

*Primary Examiner*—Jacqueline V. Howard
(74) *Attorney, Agent, or Firm*—Nixon & Vanderhye

(57) ABSTRACT

An open gear lubricant has a lubricant base comprising a major amount of a vegetable oil and a minor amount of a solid inorganic lubricant, thickened with a bidegradable organoclay gellant.

22 Claims, No Drawings

OPEN GEAR LUBRICANTS

CROSS REFERENCE TO RELATED APPLICATION

This is a U.S. National phase of PCT/GB 98/00506 filed Feb. 18, 1998.

BACKGROUND AND SUMMARY OF THE INVENTION

This invention relates to an open gear lubricant and is particularly directed to open gear lubricants which are biodegradable.

Open gear lubricants are subject to particularly difficult operating conditions. Thus, not only must the lubricant perform its basic function of minimising friction and metal to metal contact between moving surfaces but it must also withstand the pressure, temperature and operating conditions found in difficult environments. Thus, for example, in mining operations, the machinery is exposed to an atmosphere of solid contaminants such as dust and minerals and to moisture in the form of humidity, rain and/or snow. Thus, the basic requirements for an open gear lubricant can be listed as follows 1. Tackiness and adhesion: the protecting film must strongly adhere to the surface to be lubricated without peeling or excessive throw-off;
2. Extreme pressure resistance: should withstand heavy load and shock loading;
3. Heat resistance: should not flow or harden in service and should not run even if applied on vertical surfaces;
4. Water resistance: should withstand water washout;
5. Mechanical shear stability: should not significantly change its consistency in service;
6. Dust resistance: should be able to withstand incorporation of a large amount of dust without losing its lubricating properties;
7. Pumpability: the product must be pumpable at low ambient temperature;
8. Reversibility: should be stable under repeated hot and cold cycling.

Recent years have seen a growth in interest in the provision of environmentally friendly lubricants. This is particularly true for systems where the lubricants may be lost after use or accidentally come in contact with the environment. Several biodegradable precursors such as synthetic esters and vegetable oils have been proposed for use in lubricants. Thus, such lubricants are discussed in 1. Mang T, Environmentally harmless lubricants, NLGI Spokesman, September 1993, Volume 57, Number 6.
2. Dicken T. W., Biodegradable greases, Industrial lubrication and Technology, Vol 46, No. 3, 1994.
3. Kitamura N, Biodegradable lubricants, Japanese Journal of Tribology, Vol 38, No. 5,1993.
4. Honary L. a.t. (1994), Potential utilization of soybean oil as industrial hydraulic oil, SAE Technical Paper # 941760, Warrandle, Pa.: SAE Publications.
5. Rohers I, Rossrucker T, Performance and ecology - two aspects for modern greases, Presented at the NLGI meeting, Palm Springs, Calif., Oct. 23–26, 1994.

However, the provision of a biodegradable lubricant, which is suitable for open gear applications with their severe performance requirements, has proved a difficult problem.

The present invention seeks to provide acceptable biodegradable open gear lubricants which perform at least as well as conventional mineral oil based products under a range of operating conditions.

According to this invention we provide a lubricant, intended for use in open gear applications, having a lubricant base which comprises a major amount of a vegetable oil and a minor amount of a solid inorganic lubricant, the lubricant being thickened with a biodegradable organoclay gellant.

The vegetable oil base stock can be selected from a wide range of available materials including canola, linseed, castor, sunflower, corn and soyabean oils which all exhibit high degrees of biodegradability whilst being abundant, renewable, economically viable and non toxic and exhibiting good lubricanting qualities in terms of lubricity, temperature-viscosity relationship (VI), stability and generally good seal compatibility. A preferred base stock is soyabean oil.

The vegetable oil is blended with a solid inorganic lubricant which is selected dependent on the intended conditions of operation of the lubricant. Thus, for some applications, such as mining equipment, walking cams, railroad wheels and switches, a suitable solid lubricant is a combination of carbon black and graphite while in other applications, especially where water resistance is required, a suitable inorganic lubricant is calcium carbonate. Other solid lubricants may be employed such as tricalcium phosphate and calcium hydroxide.

The preferred thickener is a biodegradable organoclay gellant such as Baragel 10 (an organoclay available from Rheox Inc.). Other clays may be employed such as montmorillonite and hectorite.

The lubricant may include a range of additional additives dependent on the end use and desired properties of the lubricant. These materials are selected so as not to adversely affect the global biodegradability of the product but to give better dispersability and stability, higher extreme pressure properties, better tackiness and adhesion and better resistance to water washout and inhibition to corrosion. Thus, for example, the lubricant may include minor amounts of additive selected from polar activators, plasticizers, anti-wear/extreme pressure additives and metal deactivators.

The vegetable oil is preferably present in an amount of at least 50% by weight of the lubricant, more preferably 60–80%. The solid inorganic lubricant is preferably present in an amount of 15–30% by weight. The organoclay gellant is preferably present in an amount of 2–8% by weight.

The lubricant is preferably prepared by blending the organoclay gellant with the vegetable oil followed by incorporation of the inorganic lubricant and other performance additives. The additional performance additives are preferably added at a temperature which is kept suitably low enough to prevent decomposition. The organoclay gellant is preferably incorporated into the vegetable oil at high shear rates in order to delaminate the organoclay platelets for thickening the base stock. We have found that lubricants in accordance with the invention, while utilising the known useful properties of vegetable oils, overcome some of the perceived undesirable properties of vegetable oils such as low oxidative hydrolytic and thermal stability. Indeed, we have found that for open gear applications, the oxidising of the vegetable oil has desirable consequences in that a tough and strong lubricating film is obtained as a result of polymerization reactions, water resistance is substantially improved and thermal retention, tackiness and adhesion to the metallic surfaces are improved also.

The lubricants of the present invention are intended to be suitable for use in applications such as mining equipment, walking cams and railroad wheels and switches.

DETAILED DESCRIPTION

The following examples illustrate the invention.

EXAMPLE 1

The components in the table below were blended as described below

| Component | % weight |
|---|---|
| 680 Blown Soyabean Oil | 63.65 |
| Baragel 10 | 3.00 |
| Arconate 1000 | 0.30 |
| Carbon Black ConductX | 3.00 |
| Graphite 1176 | 22.00 |
| Viscoplex 7-300 | 4.50 |
| Anglamol 33 | 2.50 |
| Lubrizol 5077 | 1.00 |
| Cuvan 826 | 0.05 |

680 Blown Soybean Oil is a vegetable oil available from Cargill Technical Oils. Baragel 10 is an organoclay available from Rheox Inc. Arconate 1000 is a polar activator available from Arco Chemical Company. Carbon Black Conducts is a solid lubricant available from TCR Industrial Inc. Graphite 1176 is a solid lubricant available from Dixon Tigonderoga Company. Viscoplex 7–300 is a plasticizer available from Huls America Inc. Anglamol 33 and Lubrizol 5077 are anti-wear extreme pressure additives available from Lubrizol Corporation. Cuvan 826 is a metal deactivator available from R. T. Vanderbilt Company Inc.

The blending was carried out as follows:

The specified amount of 680 Blown Soybean Oil was poured into a kettle. The requisite amount of Baragel 10 was added to the 680 Blown Soybean Oil and blended at high shear for 30 minutes in order to properly delaminate the organoclay platelets and thicken the base stock. Arconate 1000 was then added to the blend and mixed for one hour at high speed in order to properly stabilize the dispersion. The addition of the solid lubricants (Carbon Black ConductX and Graphite 1176) was performed also at high speed for at least 30 minutes. Some attention must be paid to the temperature increase as a result of the high mixing between the large amount of solids and the rest of the mixture. The Viscoplex 7–300 was added after reducing the mixing speed. A duration of 15–20 minutes was found to be sufficient to obtain an homogenous blend. The remaining ingredients were similarly blended into the mixture. It was imperative to make sure that the temperature was below 160° F. before adding the performance additives. In general these additives are unstable at elevated temperatures. The manufacturing process was finalised by pumping the product through a mill or other homogenizer system. The high shear provided by these devices established the organoclay matrix which resulted in the desired grease consistency, and eventually, its stability over time.

Samples of the lubricant compositions obtained gave products with an NLGI grade 0, unworked penetration of 379 and worked penetration of 380 at 77° F. The products were subjected to the following tests Smoothness/Film adhesion and strength This visual testing, applied to open gear products, allows one to qualitatively evaluate the product smoothness and the film adhesion and strength. A small sample was applied on a smooth surface of an aluminium top bench. It was spread, first in a thick film to check the product smoothness, and after that, by means of a spatula, in a very thin layer, to check the film adhesion and strength. The tested sample was very smooth, free of lumps and agglomerates and exhibited a tacky, adhesive and tough film.

Pumpability

The product pumpability at low temperatures (+30° F., +20° F.) was determined by the Modified Lincoln Ventmeter Test method from "The Lubrication Engineers Manual US Steel", which is incorporated herein for reference. The modified test method is briefly described as follows. The grease was charged by the means of a lever gun into a standardized coil and then placed into a cooling bath in which a thermometer is immersed. A stirrer was placed in the bath to ensure temperature homogenization. The grease is compressed with the lever gun until a pressure of 1800 Psi is attained. The bath cooling was set and maintained in service until the desired temperature was obtained. During the cooling step, the pressure was kept at 800 Psi by using the lever gun. After 15 minutes of thermostating at the testing temperature, the outlet valve was released. The chronometer was started once the needle started to move. The indicated pressure after 30 seconds represents the Ventmeter result. The test results obtained with the mentioned procedure were as low as 400 psi at +20° F. and 150 psi at +30° F. An equivalent mineral oil based grease gave around 600 Psi at +30° F. and around 1100 Psi at +20° F. These results mean that the lubricant of the invention had better pumpability at low temperatures than mineral oil based products.

Thermal Retention

The thermal retention test evaluates the ability of a grease to adhere to metal surfaces when subjected to high ambient temperatures. The procedure consisted of applying a small amount of product (0.5–0.6 gr.) on to the a clean surface of a steel plate. The plate was placed in a vertical position in an oven already set at the testing temperature. After 30 minutes, the steel plate was removed and the trace of the sliding product was measured. The length of the sliding path, in centimeters, is a measure of the thermal retention. The test results from the above procedure was: 0 cm at 100° F. and 0.5 cm at 150° F. Similar results were obtained in the case of the petroleum based products.

Reversibility

The reversibility test evaluates the ability of a grease to conserve its original properties when exposed to extreme temperatures (high and low) and to sunlight radiation. The unworked and worked penetrations, as defined in ASTM D 1403, were used to evaluate the changes in consistency. Three samples were experimented:

(1) The first sample was kept during 7 days at 75° C. in the oven and, after that, 1 day at room temperature.

(2) The second sample was kept during 7 days at 0° C. in the refrigerator and 1 day at room temperature.

(3) The third sample (glass jar) was exposed during 8 light days at sunlight radiation and at a temperature, during the day fluctuating between 38 and 42° C. The average change in unworked penetrations was: +3 points in case (1), and 2 points in cases (2) and (3). The average change in worked penetrations was: −2, +4 and respectively 0. Taking into account the precision limitations of the ASTM D 1403 test method, it was considered that the low values of changes in consistency, demonstrate that the lubricant of the invention had good stability under repeated cooled and heated cycles.

Dust Resistance

This test evaluates the capacity of the grease to hold mining dust, without losing the lubricating properties. The dust sample was provided by an iron mine in USA. The test consisted of progressively adding different amounts of dust to a determined quantity of grease, mixing intimately the dust with the grease by means of a spatula, and visually checking the aspect of the grease as a thick layer and then a thin film. The test was terminated when a grainy paste was obtained and the applied film showed a tendency to peel off. The test results obtained by applying the procedure above showed that, only after adding the dust in the ratio 2/1 (dust/grease) did the product start to look like a grainy paste and show signs of peeling when applied as a film. The same test was run on an equivalent mineral based open gear lubricant. An equivalent capacity of dust holding was obtained. These observations allowed one to say that the lubricant of the invention had an excellent resistance to dust.

Water resistance. Load carrying capacity. Mechanical stability In addition to the characteristics mentioned above, the product also showed improvements in water resistance, load carrying capacity and mechanical stability. The test results, summarized in Table I, show the superiority of the lubricant of the invention in comparison to the petroleum based greases.

TABLE 1

| Property | Test Method | Invention | Typical Petroleum Bases |
|---|---|---|---|
| Water spray off, % loss | ASTM D 4049 | 2.2 | 29.1 |
| Four ball EP, Load pass, Kg | ASTM D 2596 | 800 | 400–620 |
| Roll Stability | ASTM D 1831 | | |
| Points change in worked penetrations | | | |
| 2 hours @ 25° C. | | +7 | +26 |
| 2 hours @ 25° C., 10% water | | −5 | +34 |
| 2 hours @ 45° C., 10% water | | −10 | +34 |

Biodegradability

The method "OECD301F: Manometric Respirometry Test", was used to evaluate the biodegradability of the product. The method involves the preparation of a known volume of inoculated mineral medium, containing around 100 mg of sample (at least 50–100 mg ThOD/liter). The system is stirred in a closed flask at a constant temperature (+/−1° C. or closer) for up to 28 days. The consumption of oxygen is determined either by measuring the quantity of oxygen (produced electrolytically) required to maintain constant the gas volume in the respirometer flask, or from the change in volume or pressure (or a combination of two) in the apparatus. Evolved carbon dioxide is absorbed in a solution of potassium hydroxide or another suitable absorbent. The amount of oxygen taken up by the microbial population during the biodegradation of the product (corrected for uptake by blank inoculum, run in parallel) is expressed as a percentage of ThOD, or less satisfactorily, COD. The degree of biodegradation obtained was 62–75% ThOD.

This biodegradability test is in accordance with OECD Test Method 301 F.

EXAMPLE 2

Alternative vegetable oils were tested by partially replacing soyabean oil in the formulation given in Example 1 by Deodorized corn oil Deodorized dewaxed sunflower oil Boiled linseed oil Calchem C102 canola oil.

The deodorized corn oil and deodorized dewaxed sunflower oil are available from Archard Daniels Midland Company, the boiled linseed oil from Soco-Lynch Corporation and the cannola oil from Calgene Chemical Company.

The alternative vegetable oils were used to replace 10 to 20% of the soyabean oil of the formulation of Example 1 and the samples evaluated in respect of two aspects, water resistance and load carrying capacity.

The results of evaluation showed a good load carrying capacity: Weld load 500–800 Kg by Four ball EP (ASTM D 2596) and an excellent water resistance: 3–20% loss in Water Spray Off test. Values of 25–30% loss are common in typical petroleum base oil open gear greases.

The commercial preparation of the product based on combination of vegetable oils followed the same steps recommended in the manufacturing procedure presented for Example 1, except the fluid vegetable oil was added after obtaining a smooth dispersion of Baragel 10 in 680 soyabean oil.

EXAMPLE 3

Example 1 was repeated except that the dark coloured solid lubricants (graphite 1176 and carbon black ConductX) were replaced by the light coloured solid lubricant (Gamma Sperse 80) in order to improve the lubricant for severe water resistance applications.

The formulation is given below

| Component | % weight |
|---|---|
| 680 Brown Soyabean Oil | 62.30 |
| Baragel 10 | 5.00 |
| Arconate 1000 | 0.65 |
| Gamma Sperse 80 | 25.00 |
| Viscoplex 7-300 | 4.00 |
| Anglamol 33 | 2.00 |
| Lubrizol 5077 | 1.00 |
| Cuvan 826 | 0.05 |

Gamma Sperse 80 is Calcium Carbonate available from the Georgia Marble Company. The other ingredients have been already specified in Example 1. The invention showed the following characteristics and performances: Worked penetration (ASTM D 217): 380, NLGI grade: 0, Four ball EP (ASTM D 2596): 800 Kg weld load, Copper corrosion (ASTM D 4048): Pass (1a), Pumpability by Lincoln Ventmeter: 350 Psi at +30° F. Emcor Rust test (IP 220): Pass (0), Roll stability (ASTM D 1831): −2 points change, Water Spray Off (ASTM D 4049): 0.75% loss. Based on the laboratory results, as shown above, the product performed, in all the considered areas, better than the petroleum based open gear greases. Furthermore, the biodegradability test (OECD 301F test method) showed a value of 97% (ThoD).

What is claimed is:

1. A lubricant, intended for use in open gear applications, having a lubricant base which comprises a major amount of a vegetable oil and a minor amount of a solid inorganic lubricant, the lubricant being thickened with a biodegradable organoclay gellant.

2. A lubricant according to claim 1 wherein the vegetable oil is selected from soyabean oil, canola oil, linseed oil, castor oil, sunflower oil and corn oil.

3. A lubricant according to claim 2 wherein the vegetable oil is soyabean oil.

4. A lubricant according to any claim 1 wherein the solid inorganic lubricant is a combination of carbon black and graphite.

5. A lubricant according to any one of claims 1 to 3 wherein the solid inorganic lubricant is calcium carbonate.

6. A lubricant according to claim 1 wherein the organo-clay gellant is a biodegradable material selected from Baragel 10, montmorillonites and hectorites.

7. A lubricant according to claim 1 additionally containing one or more additives selected from polar activators, plasticizers, anti-wear extreme pressure additives and metal deactivators.

8. A lubricant according to claim 2 wherein the solid inorganic lubricant is a combination of carbon black and graphite.

9. A lubricant according to claim 3 wherein the solid inorganic lubricant is a combination of carbon black and graphite.

10. A lubricant according to claim 2 wherein the solid inorganic lubricant is calcium carbonate.

11. A lubricant according to claim 3 wherein the solid inorganic lubricant is calcium carbonate.

12. A lubricant according to claim 2 wherein the organo-clay gellant is a biodegradable material selected from Baragel 10, montmorillonites and hectorites.

13. A lubricant according to claim 3 wherein the organo-clay gellant is a biodegradable material selected from Baragel 10, montmorillonites and hectorites.

14. A lubricant according to claim 4 wherein the organo-clay gellant is a biodegradable material selected from Baragel 10, montmorillonites and hectorites.

15. A lubricant according to claim 5 wherein the organo-clay gellant is a biodegradable material selected from Baragel 10, montmorillonites and hectorites.

16. A method of lubricating an open gear arrangement, comprising applying to said open gear arrangement a lubricant as defined in claim 1.

17. A lubricant according to claim 2 additionally containing one or more additives selected from polar activators, plasticizers, anti-wear extreme pressure additives and metal deactivators.

18. A lubricant according to claim 3 additionally containing one or more additives selected from polar activators, plasticizers, anti-wear extreme pressure additives and metal deactivators.

19. A lubricant according to claim 4 additionally containing one or more additives selected from polar activators, plasticizers, anti-wear extreme pressure additives and metal deactivators.

20. A lubricant according to claim 5 additionally containing one or more additives selected from polar activators, plasticizers, anti-wear extreme pressure additives and metal deactivators.

21. A lubricant according to claim 6 additionally containing one or more additives selected from polar activators, plasticizers, anti-wear extreme pressure additives and metal deactivators.

22. A lubricant suitable for use in open gear applications, having a lubricant base consisting of a major amount of a vegetable oil, a minor amount of a solid inorganic lubricant, and a biodegradable organo-clay gellant as thickening agent for the lubricant.

* * * * *